United States Patent [19]

Braun et al.

[11] 4,154,479

[45] May 15, 1979

[54] HAULING SYSTEM FOR UNDERGROUND WORKINGS

[75] Inventors: Ernst Braun; Gert Braun, both of Essen-Heisingen, Fed. Rep. of Germany

[73] Assignee: Halbach & Braun, Fed. Rep. of Germany

[21] Appl. No.: 809,780

[22] Filed: Jun. 24, 1977

[30] Foreign Application Priority Data

Jul. 9, 1976 [DE] Fed. Rep. of Germany ..... 2631083

[51] Int. Cl.[2] ..... E21C 27/32

[52] U.S. Cl. ..... 299/34; 299/43

[58] Field of Search ..... 299/43, 34

[56] References Cited

U.S. PATENT DOCUMENTS 3,493,267 2/1970 Willrer ..... 299/34

FOREIGN PATENT DOCUMENTS 1207911 12/1965 Fed. Rep. of Germany ..... 299/34

1284382 12/1968 Fed. Rep. of Germany ..... 299/43

*Primary Examiner*—William Pate, III

*Attorney, Agent, or Firm*—McGlew and Tuttle

[57] ABSTRACT

A hauling system for underground operations for use in an excavation between a longwall having a mining face and a drift comprises a longwall conveyor which is adapted to be positioned along the longwall and a drift conveyor adapted to be positioned along the drift. A cycloid is positioned between the drift and the longwall conveyors and provides a connection transfer therebetween. A plurality of plane guiding profiles are disposed along the long wall and they provide means for the passage of chains of a chain drive which includes a drive motor and transmission and sprocket located on the side of the drift conveyor. A winning machine, such as a coal plane, is mounted for guiding movement over the profiles and, in order to facilitate its movement up to the location of the juncture of the longwall with the drift, there is provided a deflection device in the form of deflection sprockets for the upper and lower reaches of the endless chain conveyor which is adjustably mounted on a flange plate which is carried on the periphery of the cycloid conveyor between the drift and the longwall.

1 Claim, 2 Drawing Figures

HAULING SYSTEM FOR UNDERGROUND WORKINGS

FIELD AND BACKGROUND OF THE INVENTION

This invention relates in general to conveyors and, in particular, to a new and useful hauling system for underground workings, comprising a longwall conveyor, a drift conveyor and a winning machine, in particular, a coal plane, with the longwall conveyor and drift conveyor merging continuously in the zone of the transition from longwall to drift with interposition of a cycloid, and the coal plane being guided at the longwall conveyor along the mining face on place guiding profiles with chain passages for the upper and lower sections of a plane driving chain connected to the coal plane and pulled by its own drive unit.

DESCRIPTION OF THE PRIOR ART

Transport systems of such design are known which, in the transition zone from longwall to drift, require a machine stall for accommodating the drive unit for the plane driving chain and, hence, the coal plane. As the coal plane can be advanced only up to its drive unit and hence not into the drift, generally a stall plane is needed in addition for driving the machine stall forward. The stall plane thus operates in the zone between drift and coal plane. The use of a stall plane in addition to a coal plane is expensive. In particular, however, the machine stall and, in this connection, the fact that the coal plane cannot work over the total length of the mining face, is disturbing. As a result, the machine stall is a critical hindrance in the rationalization of the mechanized extraction of coal in underground workings. While coal planes are known which by means of whims in the drifts are pulled on the sill on the coal face side, with the ropers being deflected from the drift into the longwall by rolls, the problems concerning the composite construction in a hauling system with a cycloid and which dispenses with a machine stall have basically not be effected by these known measures.

SUMMARY OF THE INVENTION

The present invention provides a hauling system for underground workings in a composite construction with a cycloid, wherein the coal plane can operate undisturbed over the total length of the mining face without machine stall or stall plane.

The invention provides a hauling system which, in the transition zone from longwall to drift, the plane driving chain is deflected from a longwall longitudinal direction into a drift longitudinal direction by means of deflecting rolls arranged spaced from the upper and lower sections and arranged one above the other. The chain is guided along the drift conveyor up to its drive unit in the drift and the coal plane can thereby be advanced into the drift up to the deflection zone of the plane driving chain, at least with its plane loading shoe. According to the teaching of the invention, the drive unit for the plane driving chain and hence for the coal plane is moved into the spacious drift which already exists while dispensing with the machine stall. At the same time, the plane guiding profiles for the coal plane can be moved farther in the direction of the drift, so that the coal plane can finally operate in the longwall along the total mining face. Thereby, not only the machine stall, but also the otherwise required stall plane, becomes unnecessary. Satisfactory guiding of the plane driving chain exists in the deflection zone between longwall and drift in particular, for the reason that the plane driving chain does not diverge in the upper and lower sections but is deflected while spaced from the chain passages by the correlated deflection rolls, which are arranged at the chain passage distance or at the distance between the upper and lower sections of the plane driving chain. The guiding of the plane driving chain next to the drift conveyor can be done in any desired manner.

Other features essential to the invention are mentioned in the following. The deflection rolls are thus preferably designed as sprocket wheels and are lodged in a roll box, which has a profile cross-section congruent therewith with a chain inlet and a chain outlet at least on the longwall side for connection to the associated plane guiding profile. A particularly compact composite construction between the conveyor with the coal plane, the cycloid and the roll box for deflection of the plane driving chain is thereby achieved.

According to a preferred embodiment of the invention, which is of independent importance, it is provided that in the transition zone from the longwall conveyor to the drift conveyor, the roll box is fastened to the chute with interposition of a flange plate and it is mounted on the flange plate at a 45° angle between the longwall conveyor and the drift conveyor and is at least laterally displaceable. By a laterally displaceable mounting of the roll box on the flange plate, it is possible to vary the distance between the plane driving chain and the longwall conveyor on the one hand, and the drift conveyor on the other, and to adapt it to the respective requirements. Thus, for example, the possibility exists to arrange for twice as large a distance between the plane drive chain and longwall conveyor than between the plane drive chain and drift conveyor, so that in the former case, a satisfactory introduction of the plane drive chain into the chain passages of the plane guide profiles is ensured and, in the latter case, a particularly close guiding of the plane drive chain at the drift conveyor is made possible. The drive unit for the plane drive chain or the coal plane, which is located in the drift, can be arranged under the drift conveyor, resulting in a particularly compact and space-saving construction. As explained above, in the hauling system according to the invention, the use of a stall plane can be advantageously dispensed with. Independently of this, the possibility also exists that the coal plane may be designed as a stall plane, and separately thereof, a main plane as the coal plane, is guided at the longwall conveyor, which is then given its own drive unit.

The advantages achieved by the invention must be seen essentially in that a hauling system for underground workings comprising a longwall conveyor, drift conveyor and winning machine, namely, a coal plane, is provided, wherein the coal plane, dispensing with the usually required machine stall and stall plane, is able to operate over the total length of the mining face in the longwall. Thereby, the mechanical extraction of coal, taking into consideration a composite construction with a cycloid, is further rationalized and the plane output increased considerably.

An object of the invention is to provide a hauling system for underground operations for use in an excavation between a longwall which has a mining face and a drift, comprising a longwall conveyor and a drift conveyor joined by a cycloid conveyor therebetween with profile devices along the longwall over which a winning machine is employed, such as a coal plane, and which also includes a drive chain for the operation of the coal plane which is mounted with its drive motor and drive sprocket along the drift conveyor and which includes a deflection roller set at the location of the cycloid conveyor which deflects the chain conveyor around the juncture from the drift to the longwall and through the passage means defined in the profiles which support the winning machine.

A further object of the invention is to provide a hauling system for underground operations which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figures 1, 2:
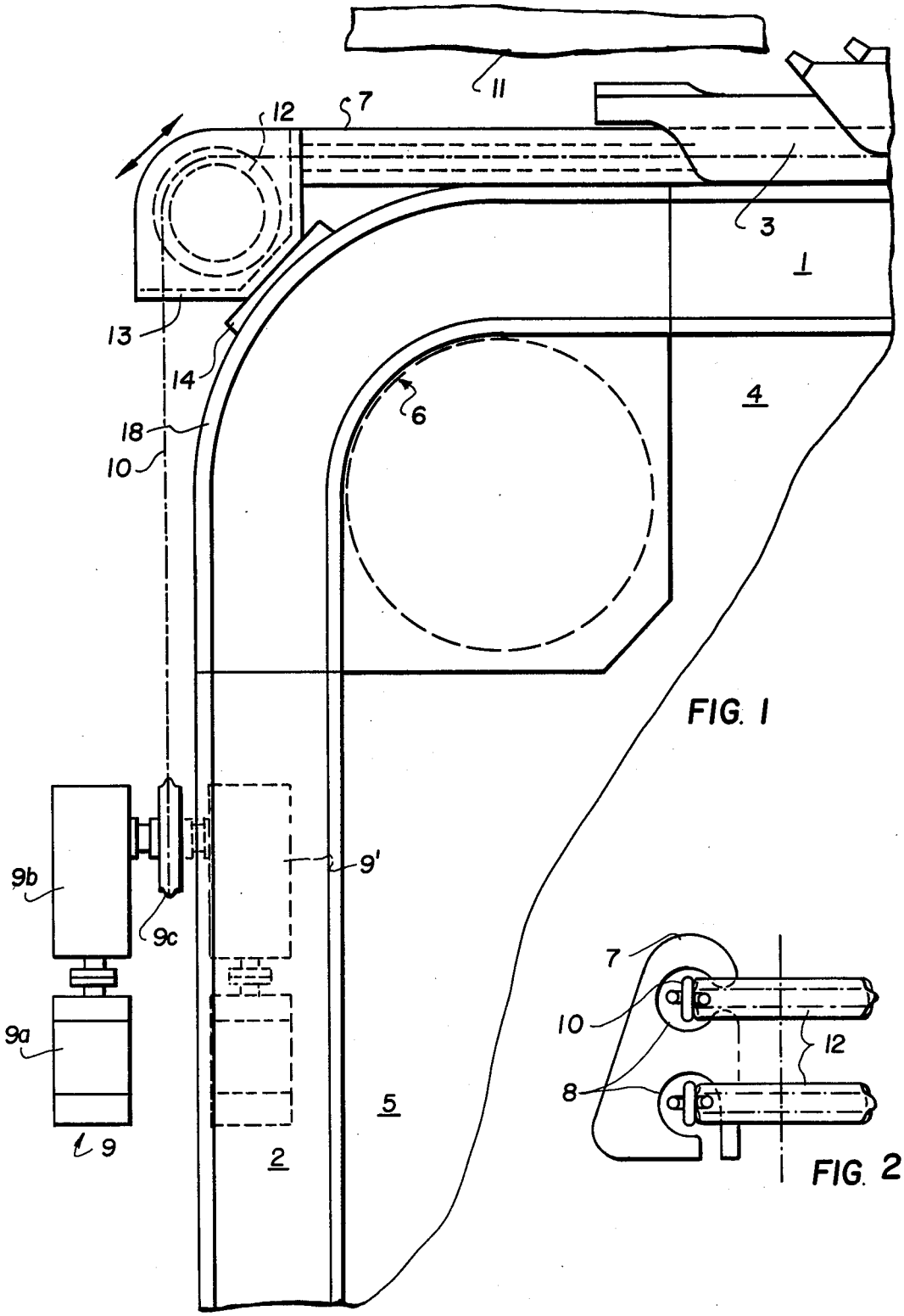
FIG. 1 is a schematic plan view of a hauling system constructed in accordance with the invention.
FIG. 2 is a front view of the profile support for the winning machine and of the deflection rollers of the deflection device.

Referring to the drawing in particular, the invention embodied therein, comprises a hauling system for underground mining operations for use in excavations between a longwall 4 having a mining face 11 and a drift 5.

As seen from the drawing, a hauling system for underground workings is shown which, in its fundamental construction, comprises a longwall conveyor 1, a drift conveyor 2 and a winning machine, in particular, a coal plane 3. The longwall conveyor 1 and drift conveyor 2 merge continuously in the zone of the transition from the longwall 4 to the drift 5 with interposition of a cycloid 6. The coal plane 3 is guided at the longwall conveyor 1 along the mining face 11 on plane guiding profiles 7. The profiles 7 have chain passages 8 for the upper and lower sections of a plane driving chain 10 which is connected to the coal plane 3 and is pulled by its own drive unit 9. Drive unit 9 comprises a drive motor **9*a*, a transmission 9*b* and a sprocket wheel 9*c***.

In the transition zone, from the longwall 4 to the drift 5, the plane drive chain 10 is deflected from longwall 4 to the drift 5. The upper and lower sections of plane drive chain 10 are deflected from a longwall longitudinal direction into drift longitudinal direction by means of deflection rolls 12, 12 arranged spaced from the upper and lower sections, one above the other, and they are guided along the drift conveyor 2 up to its drive unit 9 disposed in the drift 5. Thereby, coal plane 3 can be advanced into the deflection zone of the plane drive chain 10 and, at least by its plane loading shoe, into the drift 5. The deflection rolls 12 are designed as sprocket wheel and are lodged in a roll box 13. The roll box 13 is symmetrical and is fastened to a chute 18 in the transition zone from the longwall conveyor 1 to the drift conveyor 2 with interposition of a flange plate 14. The attachment may be effected by means of plug-in connections or by screw connections guided in slots, which is not shown. The roll box 13 is mounted at least laterally displaceable on the flange plate 14, arranged at an angle of 45° between longwall conveyor 1 and drift conveyor 2, through the plug-in connection or slot connection. The laterally displaceable mounting is indicated by a double arrow and the thereby variable spacing between the plane drive chain 10 and the longwall conveyor 1 on the one hand and the drift conveyor 2 on the other by a dash-dot line.

Drive unit 9 for the plane drive chain 10 or for the coal plane 3, respectively, is arranged either in the drift 5 next to the drift conveyor 2, or under the drift conveyor as indicated in broken lines at 9'. The coal plane 3 may incidentally be designed as a stall plane and, separately therefrom, a main plane (not shown) as operating coal plane may be guided at the longwall conveyor 1. A particularly compact composite construction is obtained when the roll box 13 has a profile cross-section congruent therewith with chain inlet and chain outlet for connection to the associated or end side plane guiding profile 7, at least on the longwall side.

While a specific embodiment of the invention has been shown and described in detail to illustrate the application of the principles of the invention, it will be understood that the invention may be embodied otherwise without departing from such principles.

What is claimed is:

1. A hauling system for underground operations for use in an excavation between a longwall having a mining face and a drift, comprising a longwall conveyor adapted to be positioned along the longwall, a drift conveyor adapted to be positioned along the drift, a cycloid conveyor positioned between said draft and said longwall conveyors providing a connecting transition between said longwall conveyor and said drift conveyor in the zone of the transfer between the drift and the longwall, plane guiding profile means disposed along said longwall and having a conveyor chain access therethrough, a winning machine mounted on said plane guiding profile means for movement therealong in operation against said mining face, a conveyor deflector including upper and lower chain sprockets, means mounting said conveyor deflector at the periphery of said cycloid conveyor permitting rotation as said sprockets about a vertical axis, conveyor drive means including a rotatable drive sprocket located alongside said drift and including a conveyor chain engaged over, and driven by, said drive sprocket and having upper and lower sections engaged on respective upper and lower deflection sprockets and guided along the longwall in said plane guiding profile means, said winning machine being movable along the longwall into the drift up to the deflection rollers, a flange plane mounted on the outer periphery of said cycloid conveyor, said deflection device being mounted on said flange plate for lateral displacement therealong between said longwall conveyor and said drift conveyor, said plate being disposed at an angle of 45° between said longwall conveyor and said drift conveyor.

* * * * *